US006467124B1

(12) United States Patent
Small

(10) Patent No.: US 6,467,124 B1
(45) Date of Patent: Oct. 22, 2002

(54) CEILING TEXTURE SCRAPING TOOL WITH VACUUM SYSTEM AND METHOD OF MAKING SAME

(76) Inventor: John F. Small, 2421 Coach Dr., Spring Valley, CA (US) 91978

( * ) Notice: Subject to any disclaimer, the term of this patent is extended or adjusted under 35 U.S.C. 154(b) by 50 days.

(21) Appl. No.: 09/708,231

(22) Filed: Nov. 7, 2000

(51) Int. Cl.[7] ..... A47L 9/02
(52) U.S. Cl. ..... 15/401; 15/322; 15/353
(58) Field of Search ..... 15/321, 322, 352, 15/353, 393, 401

(56) References Cited

U.S. PATENT DOCUMENTS 2,843,866 A * 7/1958 Hancock
4,765,352 A * 8/1988 Strieter
4,782,844 A * 11/1988 Hughes
4,826,514 A * 5/1989 Griffis
4,947,515 A * 8/1990 Ivarsson
5,564,155 A * 10/1996 Monesson
5,575,035 A * 11/1996 Reis et al.
5,951,781 A * 9/1999 Lucas
6,018,843 A * 2/2000 Disanza
6,295,691 B1 * 10/2001 Chen

* cited by examiner

*Primary Examiner*—Terrence R. Till
(74) *Attorney, Agent, or Firm*—Richard D. Clarke

(57) ABSTRACT

A new and improved ceiling surface and texture removal tool is provided. More particularly, the present invention relates to a device which enables a renovation professional to apply an even, continuous application of liquid to a ceiling texture or surface to facilitate rapid safe removal of said ceiling surface texture materials. The operator is provided with an adjustable scraping tool, having a replaceable scraping blade, and with handle extension attachments for conveniently reaching overhead surfaces. The resultant debris from the removal of ceiling surface or texture is immediately carried away by use of an integrally attached vacuum system, and delivered to a collection hopper for containment and subsequent disposal. The present device provides for a time saving, labor saving, ergonomic and efficient means by which to remove ceiling surfaces and textures while preventing formation of aerosols or dust particles which might otherwise be inhaled and represent a potential health hazard to the user.

20 Claims, 6 Drawing Sheets

CEILING TEXTURE SCRAPING TOOL WITH VACUUM SYSTEM AND METHOD OF MAKING SAME

BACKGROUND OF THE INVENTION

1. Field of the Invention

The present invention relates to a new and improved ceiling texture scraping tool with an integrated vacuum system and method of making same. More particularly, the present invention relates to a device which enables removal of ceiling texture materials by providing a liquid dispensing apparatus, scraper blade and vacuum apparatus mounted on an angle and length adjustable handle configured for quick, easy and safe operation.

2. Description of the Invention

Current housing shortages are placing increased demands on construction specialists to quickly renovate existing structures. Doing this in an efficient, cost-effective safe way requires development of new and improved equipment.

In addition, dust resulting from the process of removal of ceiling surfaces, textures and coatings have been found to cause hazardous conditions during renovation processes. In order to reduce particulates during removal of ceiling textures and reduce human contact with the material during removal, several elaborate systems have been developed and used in the past.

The usage of devices designed for removal of ceiling texture in the home or office are well known. Examples of different types of prior art devices for ceiling texture removal are disclosed in U.S. Pat. Nos. 5,643,403, 4,782,844, 4,765,352, 4,517,700 and 4,270,238.

In general, the structure and function of most ceiling texture removal devices involve a scraper mounted on an adjustable handle of some sort. A limited number of texture removal devices provide some means of spraying liquid to wet the surface and a vacuum mechanism to remove the texture as it is scraped from the ceiling. Some of the texture removal devices require motorization and others provide for complex mechanisms to accomplish the texture removal.

Hand held, mechanical texture removal systems are well known. Such a device is described in U.S. Pat. No. 5,643,403. A hand held mechanical scarifying and scraping mechanism is described. The texture or wall covering is moistened using a hand held, pump action spray nozzle with attached reservoir. Both the spray application procedure and the scraping procedure require a prolonged physical effort on the part of the operator. This would inevitably lead to muscle fatigue in a short period of time, particularly when ceiling wall coverings are being removed since no modifications are included for adapting the scraping mechanism to overhead surfaces.

Additionally, the spray application would be uneven due to the mechanical means of application and the scraping procedure would in turn be inefficient because of the uneven saturation of the wall covering.

There is no mechanism provided for the safe and effective removal and containment of the material being removed from the wall after the scraping procedure. It is assumed that the debris resulting from the wall covering removal process would be removed mechanically which would lead to possible production of free flying dust particles which could easily be inhaled during the process.

Therefore, it would be highly desirable to have a new and improved device for ceiling texture removal which would allow continuous and even application of a liquid, which would provide a means of modifying the device to adapt the scraping mechanism to overhead surfaces, and which would provide an attached vacuum for continuous removal of the texture as it is being scraped from the surface of the wall or ceiling.

The device described in U.S. Pat. No. 4,782,844 addresses the problem of a providing a means for even distribution of a liquid spray by providing a manifold for that purpose.

In addition, a vacuum mechanism is provided for the removal of materials which have been loosened by the action of the surface removal head. The surface removal head could be a mechanical shredder, ultrasonic, sonic, or ultraphonic and is adjustable by means of a plurality of guide rods to treat overhead surfaces. However, the complex surface removal head, worm gear, motorized mechanism and vacuum system are extremely complex. This would require specialized parts, trained technicians for repair and maintenance of the unit and would result in expensive construction and maintenance costs.

Therefore, it would be highly desirable to have a new and improved device for ceiling texture removal which would be inexpensive to manufacture and which would be inexpensive to maintain.

U.S. Pat. No. 4,765,352 describes a device that addresses the problem of providing a vacuum system to prevent production of aerosols or free dust particles by enclosing the operator within a portable vacuum enclosure which is adjustable to different ceiling heights. However, the device does not provide for any means of even spray distribution for wetting the ceiling surface nor does it provide for a means of scraping the ceiling texture from the surface of ceilings. Presumably, the operator must use mechanical means for spraying a scraping the ceiling surface from the ceiling.

In addition, the unit is very complex and would require specialized parts and trained technicians to repair and maintain the unit which would result in expensive construction and maintenance costs.

Therefore, it would be highly desirable to have a new and improved device for ceiling texture removal which would allow continuous and even application of a liquid, which would provide a means of modifying the device to adapt the scraping mechanism to overhead surfaces, and which would be inexpensive to manufacture and maintain.

U.S. Pat. No. 4,517,700 describes a device that has an adjustable handle attached to a scraping mechanism with attached pad for sandpaper or paint pad which addresses the problem of providing an adjustment mechanism for overhead surfaces. However, this inventive apparatus does not provide a means for continuous spraying of a liquid prior to scraping or a vacuum means for removal of surface materials after removal from a ceiling or wall surface.

Therefore, it would be highly desirable to have a new and improved device for ceiling texture removal which would allow continuous and even application of a liquid, and which would provide an attached vacuum for continuous removal of the texture as it is being scraped from the surface of the wall or ceiling.

Finally, U.S. Pat. No. 4,270,238 provides for a means of continuous even distribution of a liquid and a vacuum means for removal of any particles loosened during the process and additionally provides for an adjustable extension for working on overhead surfaces but does not provide for a means of scraping surface texture from walls or ceilings.

Therefore, it would be highly desirable to have a new and improved device for ceiling texture removal which would provide a scraping mechanism to remove surfaces and textures from ceilings, a vacuum means for removal of any particles loosened during the removal process, and a means for continuous spraying of a liquid prior to scraping where said liquid greatly facilitates rapid removal of said ceiling textures.

SUMMARY OF THE INVENTION

Therefore, the principal object of the present invention is to provide a new and improved device, for removal of ceiling surfaces and texture. An adjustable mechanism is provided for scraping the surfaces and textures. The inventive device also provides for the safe and effective removal of resultant debris by means of a vacuum mechanism. The debris is then collected and contained within a storage hopper for subsequent disposal.

It is a further object of the present invention to provide such a new and improved device for ceiling surface and texture removal, which includes means for a applying a continuous and even spray of liquid to the surfaces to be removed. The applied liquid aids in loosening the ceiling surface or texture prior to removal and decreases production of dust particles during the process, thereby greatly facilitating the removal process.

It is a further object of the present invention to provide such a new and improved device for ceiling surface and texture removal, which would provide an adjustable handle attachment for treatment of overhead surfaces to prevent muscle strain and improve efficiency during use, as well as replaceable scraper blades.

It is yet a further object of the present invention to provide such a new and improved device, for ceiling surface and texture removal, which would be inexpensive to manufacture and maintain with few moving parts that would be subject to wear and tear and subsequent frequent replacement.

Briefly, the above and further objects of the present invention are realized by providing a new and improved ceiling surface and texture removal tool. More particularly, the present invention relates to a device which enables a renovation professional to apply an even, continuous application of liquid to a ceiling texture or surface to facilitate rapid safe removal of said ceiling surface texture materials. The operator is provided with an adjustable scraping tool, having a replaceable scraping blade, and with handle extension attachments for conveniently reaching overhead surfaces. The resultant debris from the removal of ceiling surface or texture is immediately carried away by use of an integrally attached vacuum system, and delivered to a collection hopper for containment and subsequent disposal. The present device provides for a time saving, labor saving, ergonomic and efficient means by which to remove ceiling surfaces and textures while preventing formation of aerosols or dust particles which might otherwise be inhaled and represent a potential health hazard to the user.

BRIEF DESCRIPTION OF THE DRAWINGS

The above mentioned and other objects and features of this invention and the manner of attaining them will become apparent, and the invention itself will be best understood by reference to the following description of the embodiment of the invention in conjunction with the accompanying drawings, wherein.

DESCRIPTION OF THE PREFERRED EMBODIMENTS

Figure 1:
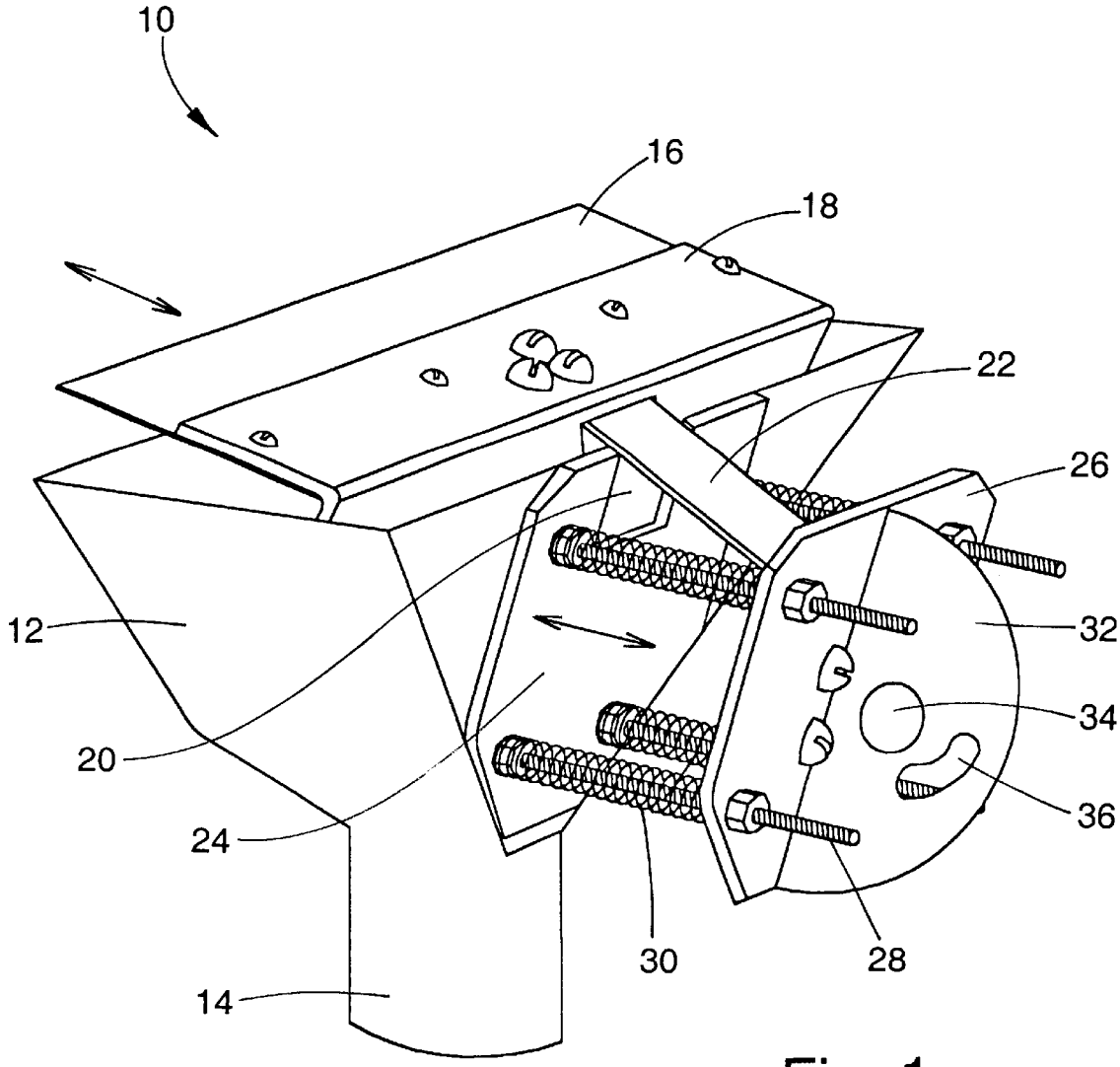
FIG. 1 is a perspective view of the novel ceiling texture scraping tool with arrows indicating movement of scraper blade relative to tool housing constructed in accordance with the present invention.

Referring now to the drawings, and more particularly to FIG. 1 thereof, there is shown a new ceiling texture scraping tool 10 which is constructed in accordance with the present invention. The new ceiling texture scraping tool 10 is used to efficiently, effectively and economically provide removal of ceiling texture by providing an adjustable ceiling scraping mechanism with attached vacuum device for containment and removal of associated debris.

Referring to FIG. 1, a scraping tool housing 12 is the primary structural component of the novel ceiling texture scraping tool 10. The vacuum hose accepting portion 14 of the a scraping tool housing 12 forms the base of the ceiling texture scraping tool 10. A replaceable scraping blade 16 is attached to a scraping blade mounting plate 18 by any number of means including but not limited to bolts and nuts, screws, friction fittings, etc. The scraping blade mounting plate 18 is attached to a mounting plate support arm 22 which then passes through a scraper housing support plate 24 through a slot 20. The distal end of this mounting plate support arm 22 is attached to a handle support plate. A multiplicity of threaded rods as exemplified by threaded rod 28 then moveably attaches the handle support plate 26 to the scraper housing support plate 24. A multiplicity of springs as exemplified by spring 30 are located between the handle support plate 26 to the scraper housing support plate 24 and are held in place by the multiplicity of threaded rods as exemplified by threaded rod 28.

A handle attachment plate 32 is perpendicularly attached to each half of a handle support plate 26 and come together at the juncture of the two halves of the handle support plate 26. A handle attachment bolt 34 passes through the two layers of the handle attachment plate 32 and together with a handle swivel slot 36 allow the attachment of any number of handles of different lengths and configurations depending upon the needs of the user. When a handle is thus attached to the handle support place 26, the user may move the replaceable scraping blade 16 forward at a wall-ceiling juncture by simply applying forward pressure on the handle.

Figure 2:
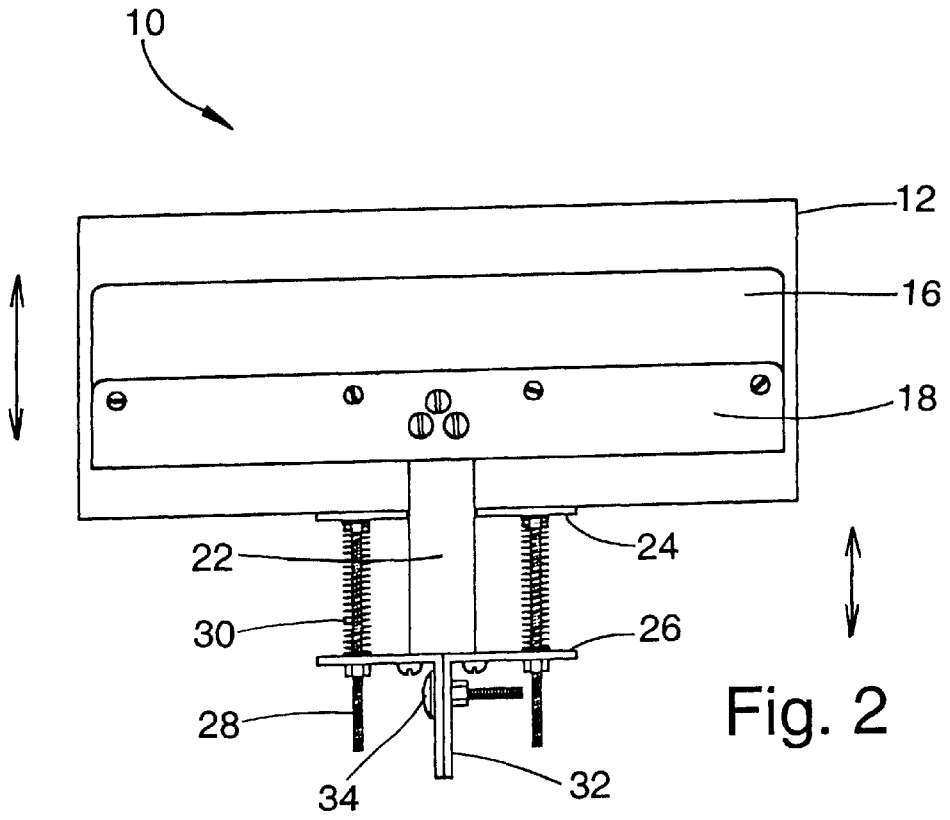
FIG. 2 is a top view of the novel scraping tool according to the present invention.

Turning now to FIG. 2, a top view of the novel ceiling texture scraping tool 10, the scraping tool housing 12 is illustrated with a replaceable scraping blade 16 attached to a scraping blade mounting plate 18. The scraping blade mounting plate 18 is attached to a mounting plate support arm 22 which then passes through a scraper housing support plate 24. The distal end of this mounting plate support arm 22 is attached to a handle support plate. A multiplicity of threaded rods as exemplified by threaded rod 28 then moveably attaches the handle support plate 26 to the scraper housing support plate 24. A multiplicity of springs as exemplified by spring 30 are located between the handle support plate 26 to the scraper housing support plate 24 and are held in place by the multiplicity of threaded rods as exemplified by threaded rod 28.

A handle attachment plate 32 is perpendicularly attached to the handle support plate 26 at the juncture of the two halves of the handle support plate 26. A handle attachment bolt 34 allows the attachment of any number of handles of different lengths and configurations depending upon the needs of the user.

Figure 3:
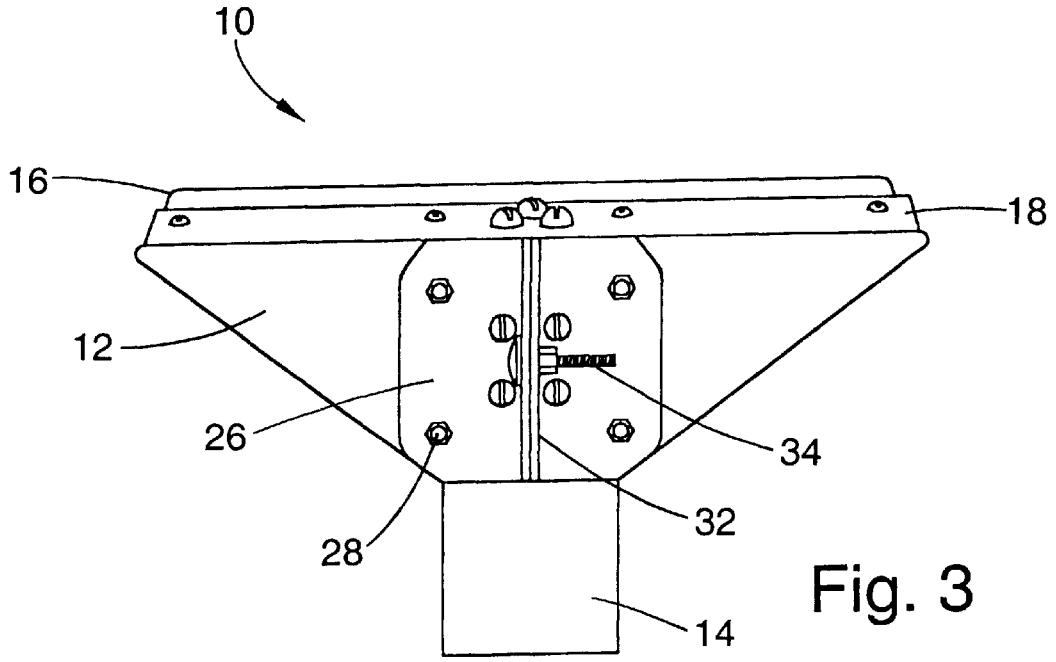
FIG. 3 is a rear elevational view of the scraping tool according to the present invention.

Referring now to FIG. 3, this rear elevational view of the ceiling scraping tool 10 shows the scraping tool housing 12 with a vacuum hose accepting portion 14. A replaceable scraping blade 16 is attached to a scraping blade mounting plate 18. A multiplicity of threaded rods as exemplified by threaded rod 28 may be seen as they pass through the handle support plate 26.

The handle attachment plate 32 is perpendicularly attached to the handle support plate 26 at the juncture of the two halves of the handle support plate 26. A handle attachment bolt 34 allows the attachment of any number of handles of different lengths and configurations depending upon the needs of the user.

Figure 4:
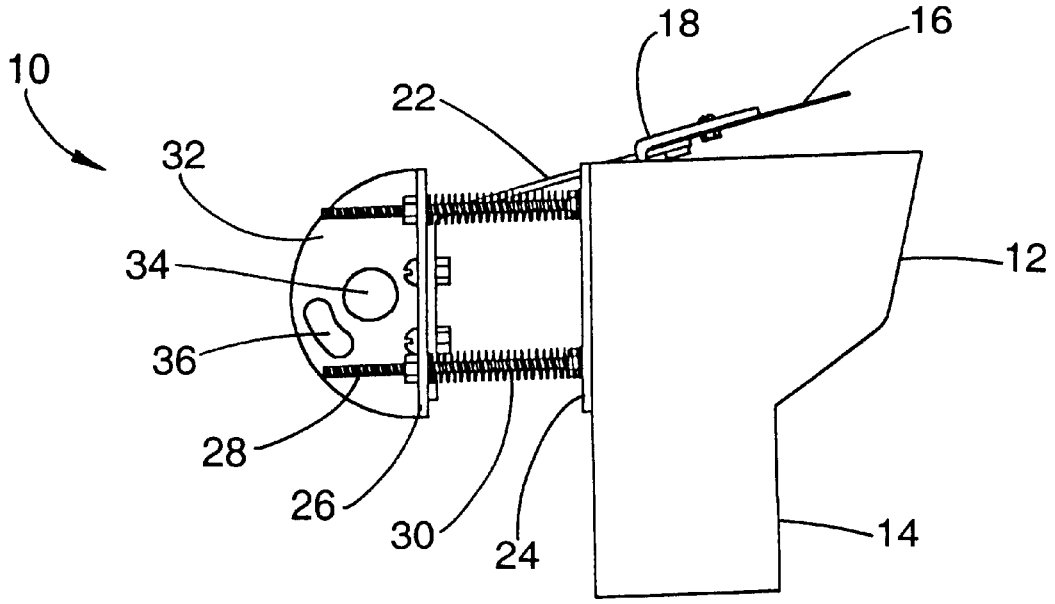
FIG. 4 is a side elevational view of the novel scraping tool with vacuum hose assembly.
Figure 4:
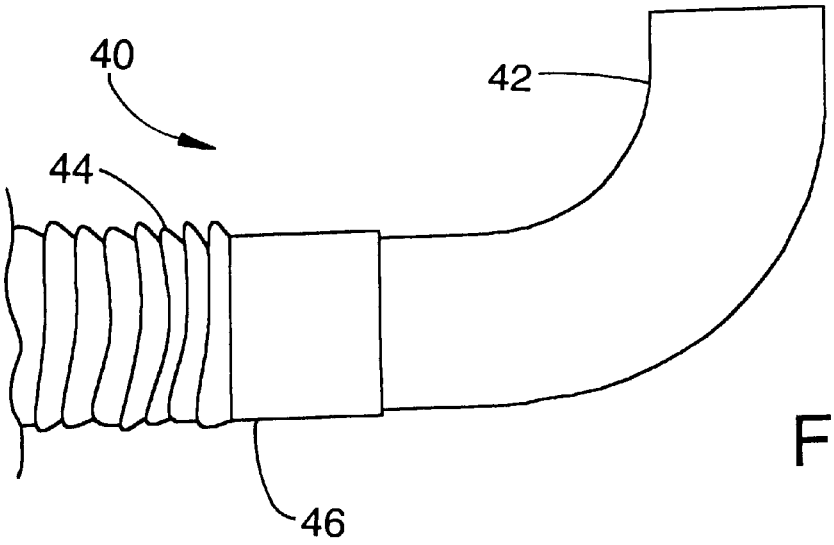

Referring now to FIG. 4, a side elevational view of the ceiling scraping tool 10 with a vacuum hose assembly is illustrated. Again, the scraping tool housing 12 with a vacuum hose accepting portion 14 is shown. A replaceable scraping blade 16 is attached to a scraping blade mounting plate 18. The scraping blade mounting plate 18 is attached to a mounting plate support arm 22 which then passes through a scraper housing support plate 24. The distal end of this mounting plate support arm 22 is attached to a handle support plate. A multiplicity of threaded rods as exemplified by threaded rod 28 then moveably attaches the handle support plate 26 to the scraper housing support plate 24. A multiplicity of springs as exemplified by spring 30 are located between the handle support plate 26 to the scraper housing support plate 24 and are held in place by the multiplicity of threaded rods as exemplified by threaded rod 28.

A handle attachment plate 32 is perpendicularly attached to a handle support plate 26 and a handle attachment bolt 34 passes through the two layers of the handle attachment plate 32 and together with a handle swivel slot 36 allow the attachment of any number of handles of different lengths and configurations.

A vacuum hose assembly 40 attaches to the vacuum hose accepting portion 14 of the ceiling texture scraping tool 10 by means of a hose elbow 42. The vacuum hose 44 is attached to the hose elbow by a hose/elbow connector piece 46.

Figure 5:
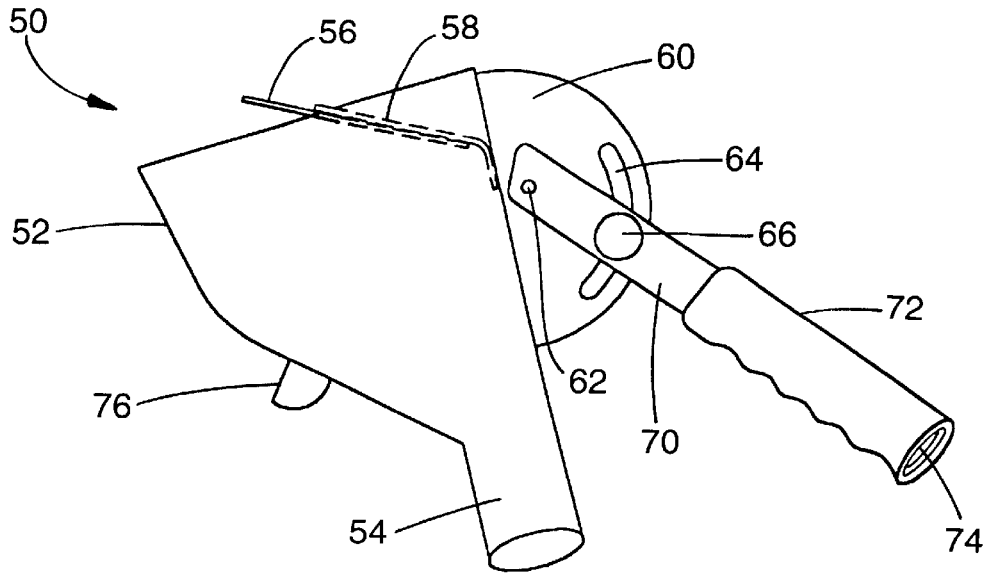
FIG. 5 is a side elevational view of an alternative embodiment of the novel ceiling scraping tool device according to the present invention.

Referring now to FIG. 5, a side elevational view of an alternative embodiment of the novel ceiling scraping tool 50. This alternative embodiment of the novel ceiling scraping tool 50 is comprised of a scraping tool housing 52 which is provided with a vacuum hose accepting portion 54. A scraping blade 56 is attached to the scraping blade mounting plate by any number of means including but not limited to bolts and nuts, screws, friction fittings. In this alternative embodiment of the novel ceiling scraping tool 50, the scraping blade 56 is welded to the scraping blade mounting plate 58 to provide for an inexpensive manufacturing technique for a disposable unit.

In this alternative embodiment of the novel ceiling scraping tool 50, the handle attachment plate 60 is attached to the scraping tool housing 52. A handle attachment bolt 62 secures the handle shaft 70 to the handle attachment plate 60. The handle swivel slot 64 accommodates the handle swivel bolt 66 and allows adjustment of the angle of the handle shaft 70 in relation to the scraping tool housing 52. The handle hand grip 72 is provided with a handle extension accepting portion 74. Additionally, a housing knob handle 76 can accommodate a removeable handle for additional support and control of the scraping tool housing 52.

Figure 6:
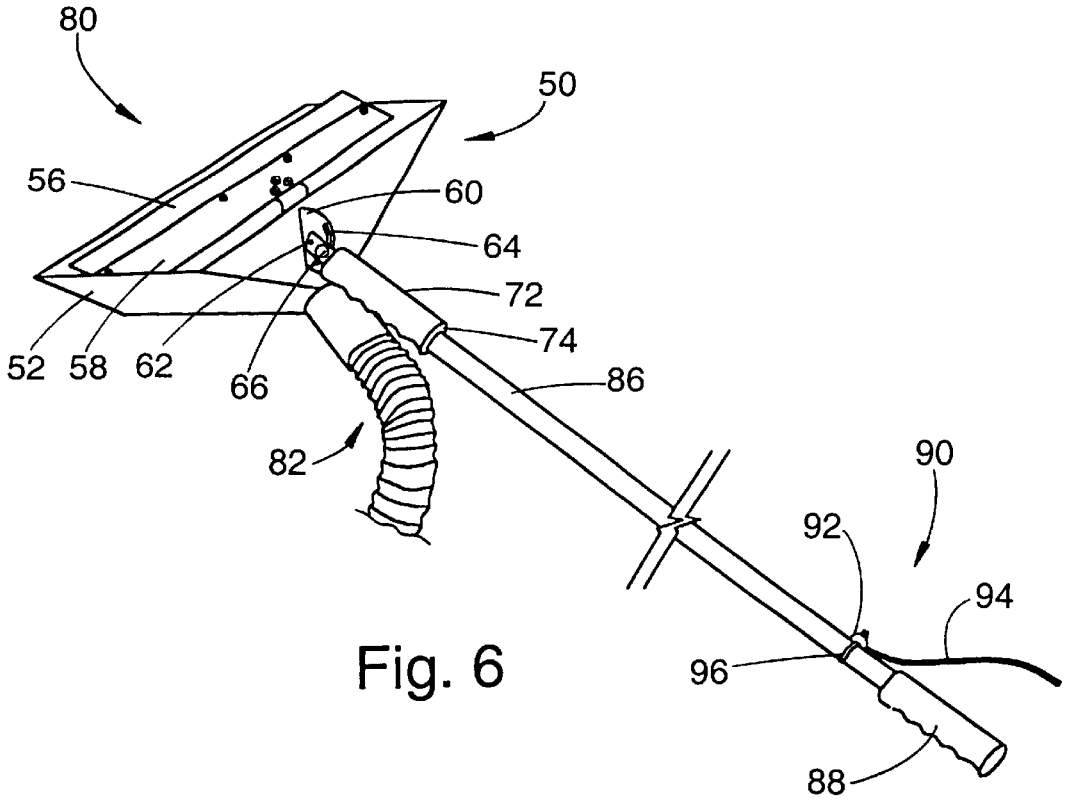
FIG. 6 is a rear perspective view of an alternative embodiment of the novel ceiling scraping tool device according to the present invention, with vacuum hose and handle extension in place.

Turning now to FIG. 6, a scraping tool with vacuum hose and handle extension 80, further illustrates the alternate embodiment of the novel ceiling scraping tool 50. A vacuum hose 82 is attached to the ceiling scraping tool 50. The scraping blade 56 may be attached to the scraping blade mounting plate 58 by any number of means. In this embodiment, the scraping blade is attached by means of screws and may be replaced in the event of damage to the blade during use. The handle attachment plate 60 is attached to the scraping tool housing 52. The handle attachment bolt 62 moveably attaches the handle shaft 70 to the handle attachment plate 60. As in FIG. 5, the handle swivel slot 64 accommodates the handle swivel bolt 66 and allows adjustment of the angle of the handle shaft 70 in relation to the scraping tool housing 52. The handle hand grip 72 is provided with a handle extension accepting portion 74 to which the handle extension 86 attaches. An on/off switch assembly 90 is comprised of a removeable electric on/off switch 92 which is secured to the handle extension 86 by means of switch fastening prongs 96 within easy reach of the handle extension hand grip 88. The on/off switch assembly is provided with an on/off switch power cord 94.

Figure 7:
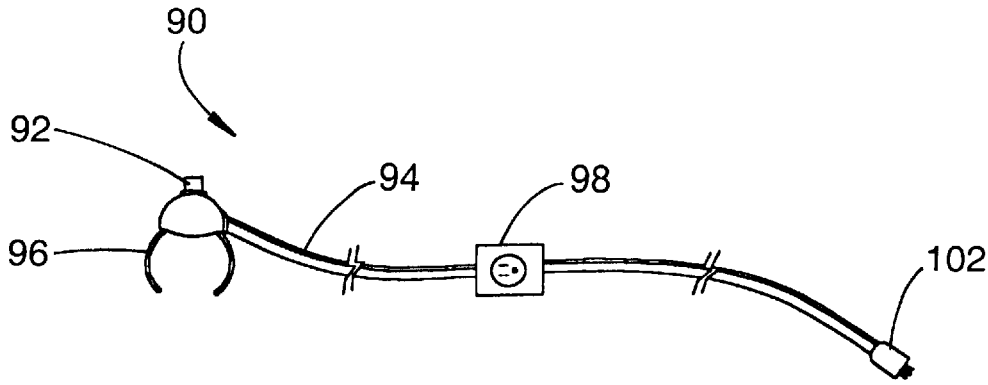
FIG. 7 is representational view of the portable power switch for vacuum on/off control according to the present invention.

Referring now to FIG. 7, a representational view of the on/off switch assembly 90 for vacuum on/off control. The removeable electric on/off switch 92 is held in place by means of the switch fastening prongs 96. A GFIC electrical outlet 98 is interspaced on the on/off switch power cord 94 for accepting a vacuum power plug. The on/off switch power cord 94 terminates with the power source plug 102.

Figure 8:
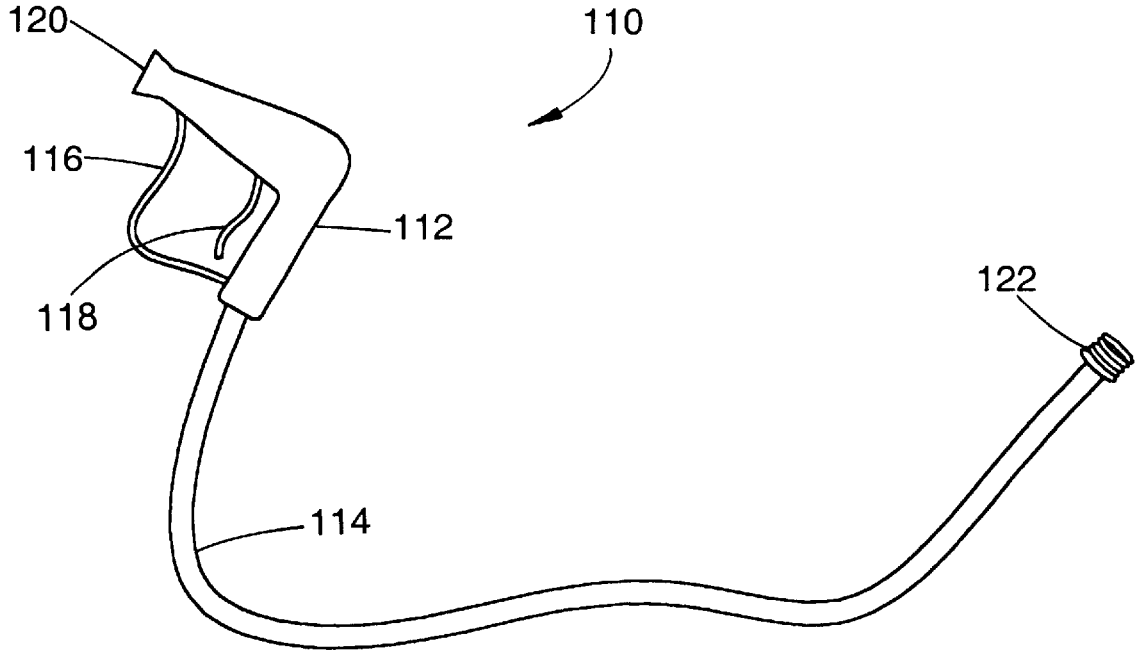
FIG. 8 is a representational view of the liquid sprayer apparatus according to the present invention.

Turning now to FIG. 8, this figure illustrates a representational view of a liquid sprayer apparatus 110. The liquid sprayer housing 112 attaches to a flexible hose 114 which is provided with a liquid source hose connector 122. A trigger guard 116 protects the users hand while on the trigger 118 and prevents accidental discharge of liquid when not in use. When depressed, the trigger activates dispensing of pressurized liquid through the spray nozzle 120 for application to a ceiling surface prior to scraping to facilitate removal of ceiling surfaces and texture.

Figure 9:
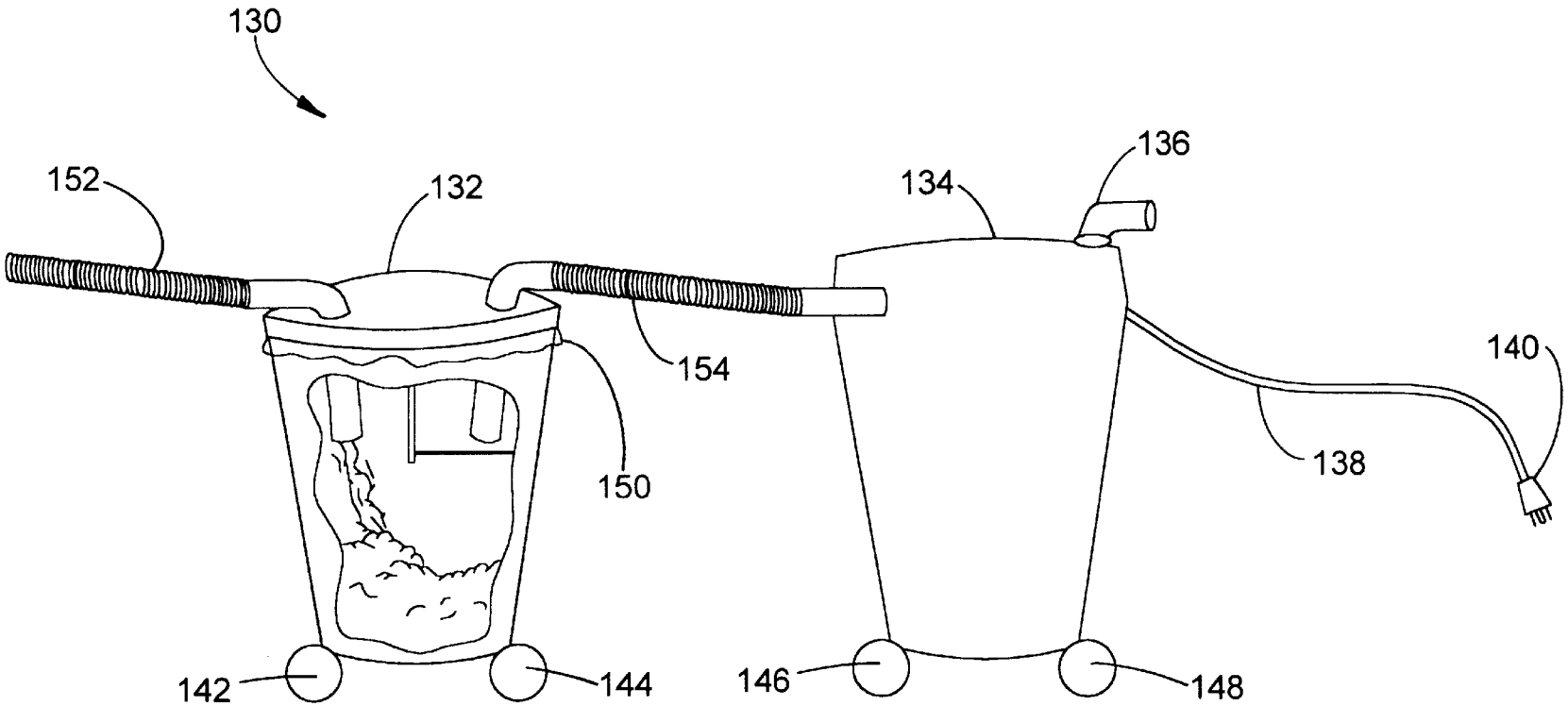
FIG. 9 is a side elevational view of the integral vacuum/collection hopper system showing a partially cut away view of the collection hopper, according to the present invention.

Finally, a side elevational view of an integral vacuum/collection hopper system 130 is shown in FIG. 9. A collection hopper 132 traps debris that is removed during the process of ceiling surface and texture removal and channeled to the collection hopper 132 by means of the scraper texture material source hose 152. The collection hopper 132 may be provided with removable and/or disposable bags, such as plastic bag 150. The collection hopper 132 is provided with a vacuum by means of a vacuum inlet hose 154. The vacuum housing 134 contains a vacuum motor (not shown) which is the source of the vacuum supply and is provided with a vacuum exhaust outlet 136. A power cord 138 and power plug 140 supply the vacuum with power. A multiplicity of roller wheels as exemplified by roller wheels 142, 144, 146 and 148 allow the user to easily move the vacuum/collection hopper system 130 when in use.

It should be understood, however, that even though these numerous characteristics and advantages of the invention have been set forth in the foregoing description, together with details of the structure and function of the invention, the disclosure is illustrative only, and changes may be made in detail, especially in matters of shape, size, chemistry and arrangement of parts within the principal of the invention to the full extent indicated by the broad general meaning of the terms in which the appended claims are expressed.

What is claimed is:

1. A ceiling texture scraping tool system comprising:

(a) a scraping blade;

(b) a tapered housing having an upper opening and a lower opening;

(c) a handle connected to and supporting said scraping blade and said housing;

(d) a liquid sprayer;

(e) a collection hopper; and (f) a vacuum system having a vacuum source, and a vacuum hose connected to said lower opening of said housing, whereby when said scraping blade removes ceiling texture materials, said upper opening of said tapered housing captures loosened material, thereby enabling said vacuum system to carry away the removed texture material.

2. The ceiling texture scraping tool system according to claim 1, wherein said scraping blade is replaceable.

3. The ceiling texture scraping tool system according to claim 1, wherein said tapered housing is generally funnel-shaped.

4. The ceiling texture scraping tool system according to claim 1, wherein said handle includes one or more handle extensions for the purpose of varying the length of said handle.

5. The ceiling texture scraping tool system according to claim 1, wherein said liquid sprayer includes a hose, and a spray nozzle for evenly applying a liquid to a ceiling surface to be removed for greatly facilitating the removal process.

6. The ceiling texture scraping tool system according to claim 1, wherein said collection hopper includes a replaceable container placed in series with said vacuum source for the purpose of containment and subsequent disposal of removed ceiling texture material.

7. The ceiling texture scraping tool system according to claim 6, wherein said replaceable container includes plastic bags for the purpose of containment and subsequent disposal of removed ceiling texture material.

8. The ceiling texture scraping tool system according to claim 1, wherein said handle supporting said scraping blade and said housing is connected to said housing such that the angle of said scraping blade can be adjusted to conform with the required angle of use of said scraping blade.

9. The ceiling texture scraping tool system according to claim 1, wherein said handle includes a secondary handle attached directly to said housing, enabling two handed operation by a user.

10. The ceiling texture scraping tool system according to claim 1, wherein said scraping blade is permanently affixed to said housing.

11. The ceiling texture scraping tool system according to claim 10, wherein said permanently affixed scraping blade is welded to said housing.

12. The ceiling texture scraping tool system according to claim 1, wherein said vacuum system is mobile.

13. The ceiling texture scraping tool system according to claim 1, wherein said vacuum system includes a remote on/off power switch located on said handle.

14. A method of making a ceiling texture scraping tool system, comprising the steps:

(a) providing a scraping blade;

(b) providing a tapered housing having an upper opening and a lower opening;

(c) providing a handle connected to and supporting said scraping blade and said housing;

(d) providing a liquid sprayer; and (e) providing a vacuum system having a vacuum source, and a vacuum hose connected to said lower opening of said housing, whereby when said scraping blade removes ceiling texture materials, said upper opening of said tapered housing captures loosened material, thereby enabling said vacuum system to carry away the removed texture material.

15. The method of making a ceiling texture scraping tool system, according to claim 14, wherein said step of providing a scraping blade includes providing a replaceable scraping blade.

16. The method of making a ceiling texture scraping tool system, according to claim 14, wherein said step of providing a handle connected to and supporting said scraping blade and said housing includes providing a handle capable of variable length extension.

17. The method of making a ceiling texture scraping tool system, according to claim 14, wherein said step of providing a liquid sprayer includes providing a liquid source, a liquid transport hose, and a controllable liquid sprayer nozzle.

18. The method of making a ceiling texture scraping tool system, according to claim 14, wherein said step of providing a vacuum system having a vacuum source, and a vacuum hose connected to said lower opening of said housing includes providing a collection hopper means integrally connected to said vacuum system.

19. The method of making a ceiling texture scraping tool system, according to claim 18, wherein said step of providing a collection hopper includes providing a collection hopper container for the purpose of collection, containment and subsequent disposal of removed ceiling texture materials.

20. The method of making a ceiling texture scraping tool system, according to claim 19, wherein said step of providing a collection hopper container includes providing plastic bags for the purpose of collection, containment and subsequent disposal of removed ceiling texture materials.

* * * * *